US006027431A

United States Patent [19]

Stearns et al.

[11] Patent Number: 6,027,431

[45] Date of Patent: Feb. 22, 2000

[54] EXERCISE METHODS AND APPARATUS WITH AN ADJUSTABLE CRANK

[76] Inventors: Kenneth W. Stearns, P.O. Box 55912, Houston, Tex. 77055; Joseph D. Maresh, P.O. Box 645, West Linn, Oreg. 97068-0645

[21] Appl. No.: 09/064,368

[22] Filed: Apr. 22, 1998

Related U.S. Application Data

[63] Continuation-in-part of application No. 08/949,508, Oct. 14, 1997, abandoned

[60] Provisional application No. 60/044,959, Apr. 26, 1997, provisional application No. 60/044,961, Apr. 26, 1997, and provisional application No. 60/044,026, May 5, 1997.

[51] Int. Cl.[7] ..... A63B 69/16; A63B 22/04

[52] U.S. Cl. ..... 482/52; 482/51; 482/57

[58] Field of Search ..... 482/51, 52, 53, 482/57, 62, 70, 71, 79, 80

[56] References Cited

U.S. PATENT DOCUMENTS

| | | | |
|---|---|---|---|
| 5,562,574 | 10/1996 | Miller | 482/51 |
| 5,577,985 | 11/1996 | Miller | 482/52 |
| 5,611,756 | 3/1997 | Miller | 482/52 |
| 5,692,994 | 12/1997 | Eschenbach | 482/51 |
| 5,743,834 | 4/1998 | Rodgers | 482/57 |
| 5,759,136 | 6/1998 | Chen | 482/57 |

FOREIGN PATENT DOCUMENTS

| | | | |
|---|---|---|---|
| 2919474 | 5/1979 | Germany | 482/51 |

*Primary Examiner*—Stephen R. Crow

[57] ABSTRACT

An exercise apparatus has a linkage assembly which links rotation of an adjustable length crank to generally elliptical movement of a force receiving member. The linkage assembly includes a first link having a rearward end which is rotatably connected to the crank, and a forward end which is rotatably connected to a lower end of a suspended link. An upper portion of the suspended link is rotatably connected to the exercise apparatus frame.

3 Claims, 17 Drawing Sheets

Fig. 7
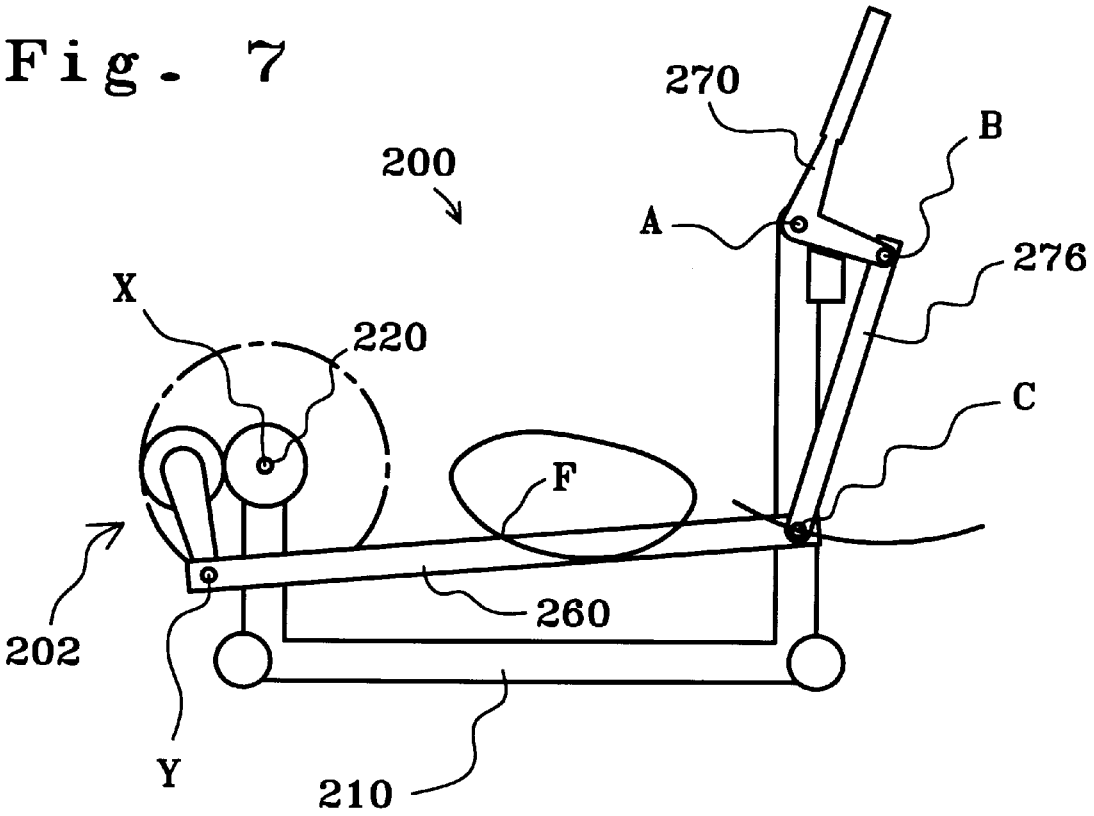
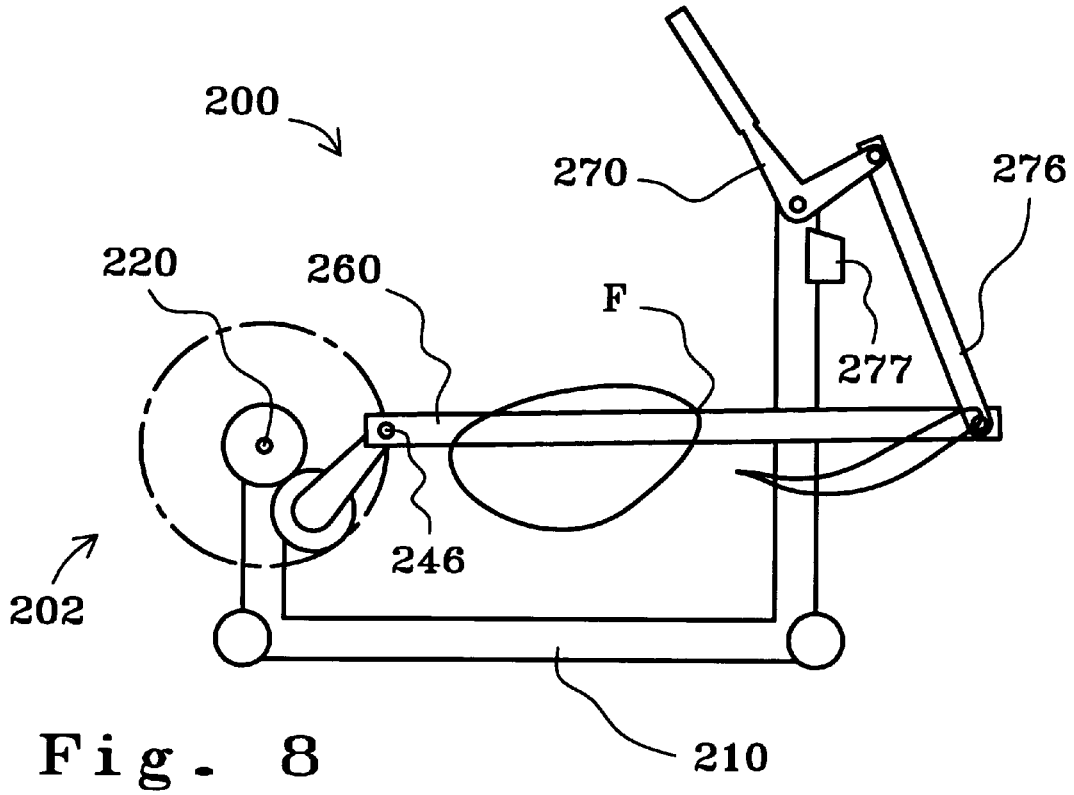
Fig. 8

Fig. 9
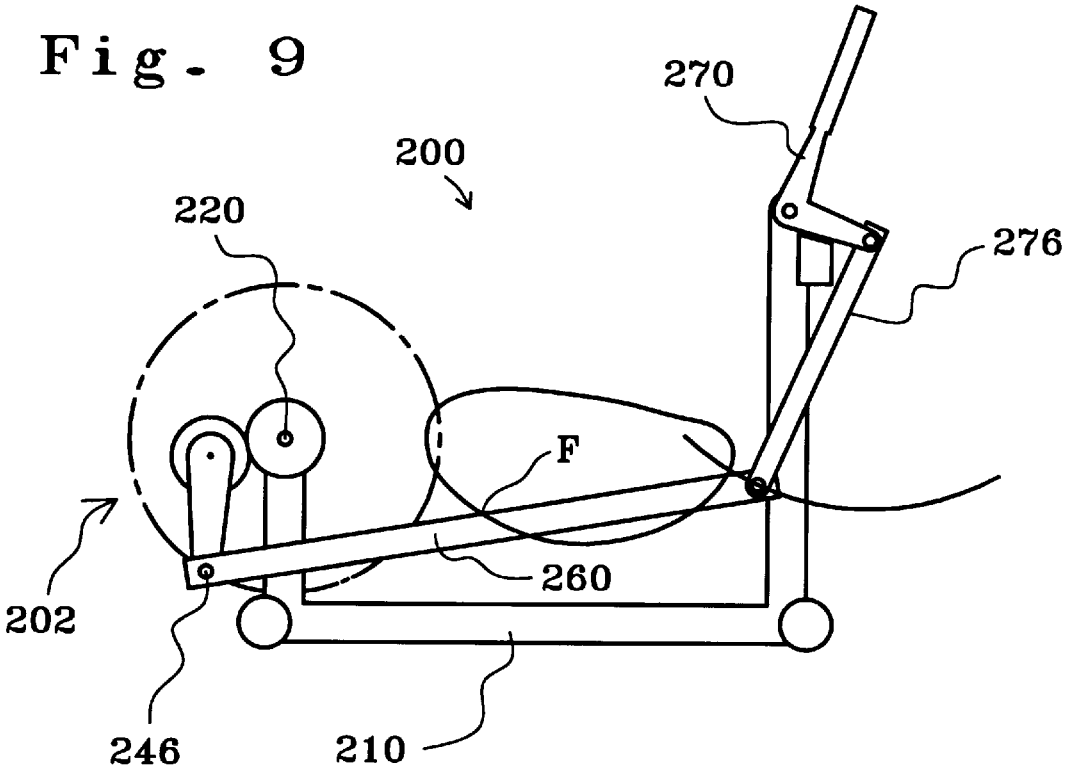
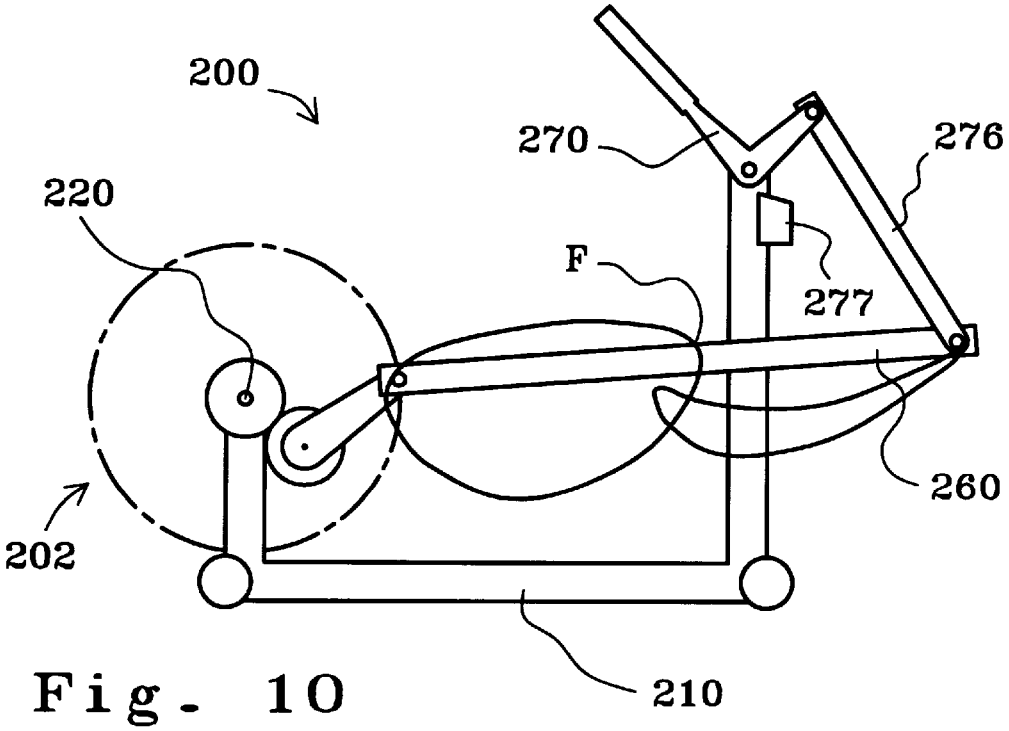
Fig. 10

Fig. 11
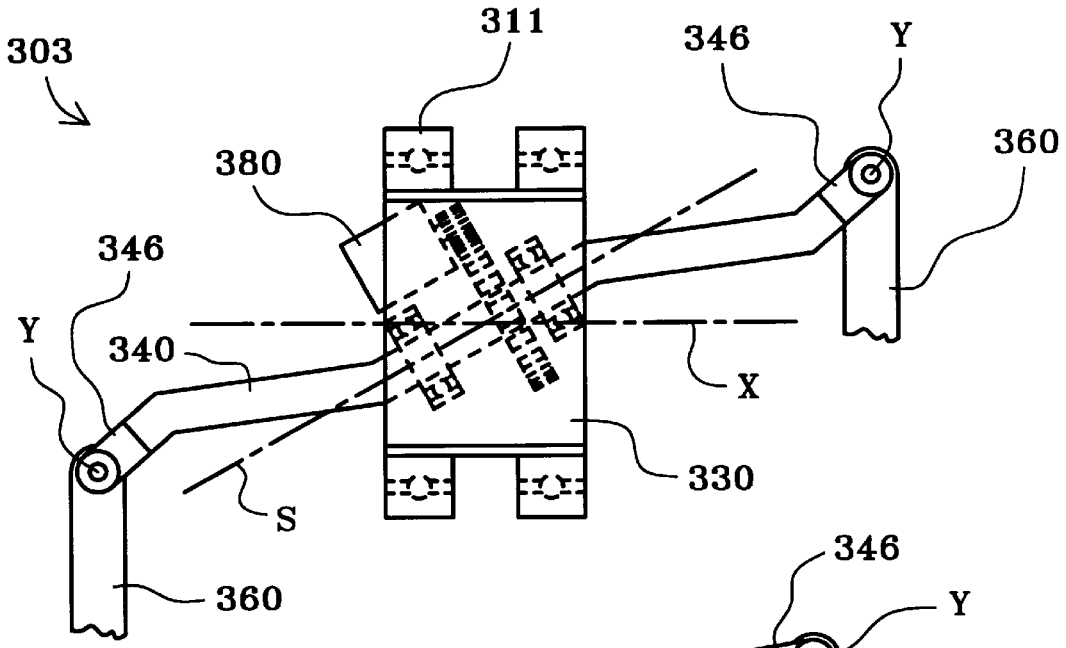
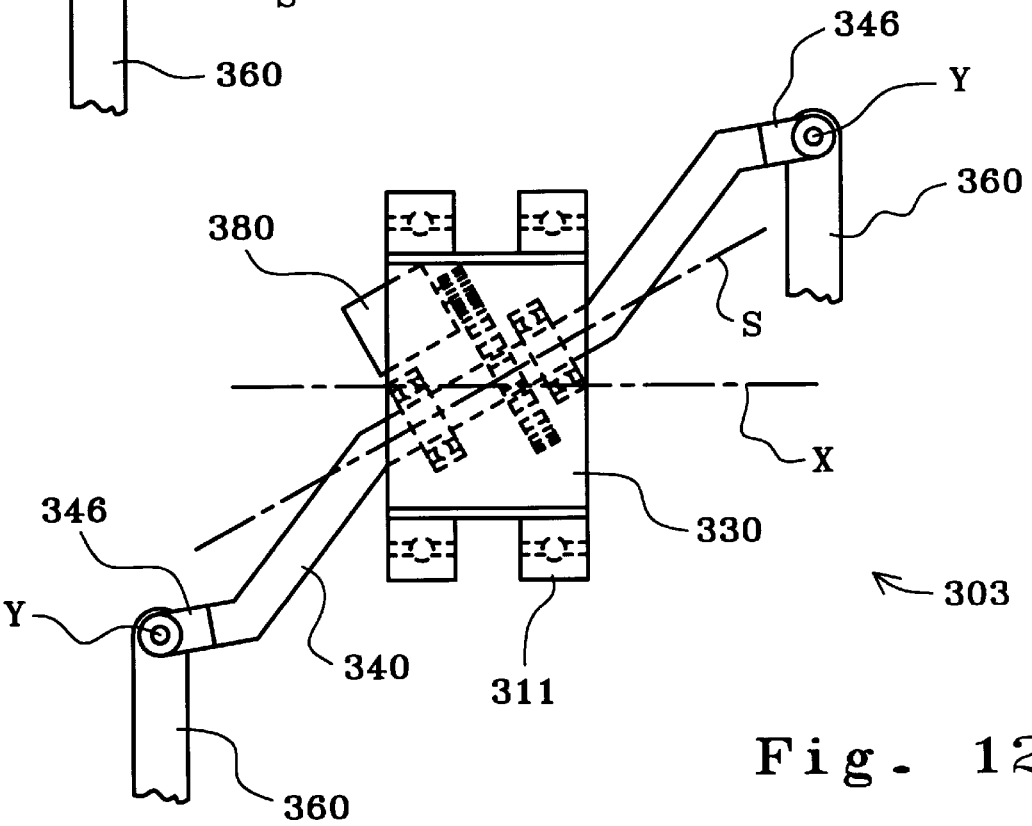
Fig. 12

EXERCISE METHODS AND APPARATUS WITH AN ADJUSTABLE CRANK

CROSS-REFERENCE TO RELATED APPLICATION

This application is a continuation-in-part of U.S. patent application Ser. No. 08/949,508, filed on Oct. 14, 1997, now abandoned, and discloses subject matter entitled to the earlier filing dates of Provisional Application Nos. 60/044,959 and 60/044,961, which were filed on Apr. 26, 1997, and Provisional Application No. 60/044,026, which was filed on May 5, 1997.

FIELD OF THE INVENTION

The present invention relates to exercise methods and apparatus and specifically, to exercise equipment which facilitates exercise through an adjustable curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Some examples of elliptical motion machines are disclosed in published German Patent Appl'n No. 29 19 494 of Kummerlin; U.S. Pat. No. 4,185,622 to Swenson; U.S. Pat. No. 5,242,343 to Miller; U.S. Pat. No. 5,423,729 to Eschenbach; and U.S. Pat. No. 5,529,555 to Rodgers, Jr.

On one hand, an advantage of elliptical motion exercise machines is that a person's feet travel both up and down and back and forth during an exercise cycle. On the other hand, a disadvantage of these machines is that the person's feet are constrained to travel through a path which is substantially limited in terms of size and/or configuration from one exercise cycle to the next. Although the above-identified references disclose how to adjust the path of foot travel, the methods are relatively crude, and room for improvement remains.

SUMMARY OF THE INVENTION

The present invention provides methods and apparatus to change the size of a path traveled by foot supports which are connected to a crank. Unlike the devices disclosed in prior art references, the present invention allows adjustments to be implemented during exercise motion, in infinitesimally small increments, and/or at the push of a single button. The features and advantages of the present invention may become more apparent from the detailed description that follows.

BRIEF DESCRIPTION OF THE DRAWING

With reference to the Figures of the Drawing, wherein like numerals represent like parts throughout the several views.

FIG. 7 is a diagrammatic right side view of an exercise apparatus which incorporates the crank adjustment assembly of FIG. 5 (with the left side linkage components omitted);

FIG. 8 is a diagrammatic right side view of the exercise apparatus of FIG. 7 with the handle moved to a second position;

FIG. 9 is a diagrammatic right side view of the exercise apparatus of FIG. 7 with the crank adjusted to a relatively greater radius;

FIG. 10 is a diagrammatic right side view of the exercise apparatus of FIG. 9 with the handle moved to a second position;

FIG. 11 is a top view of a third crank adjustment assembly constructed according to the principles of the present invention;

FIG. 12 is a top view of the crank adjustment assembly of FIG. 11 with the crank adjusted to a relatively greater radius;

DETAILED DESCRIPTION OF THE PREFERRED EMBODIMENT

Figure 1:
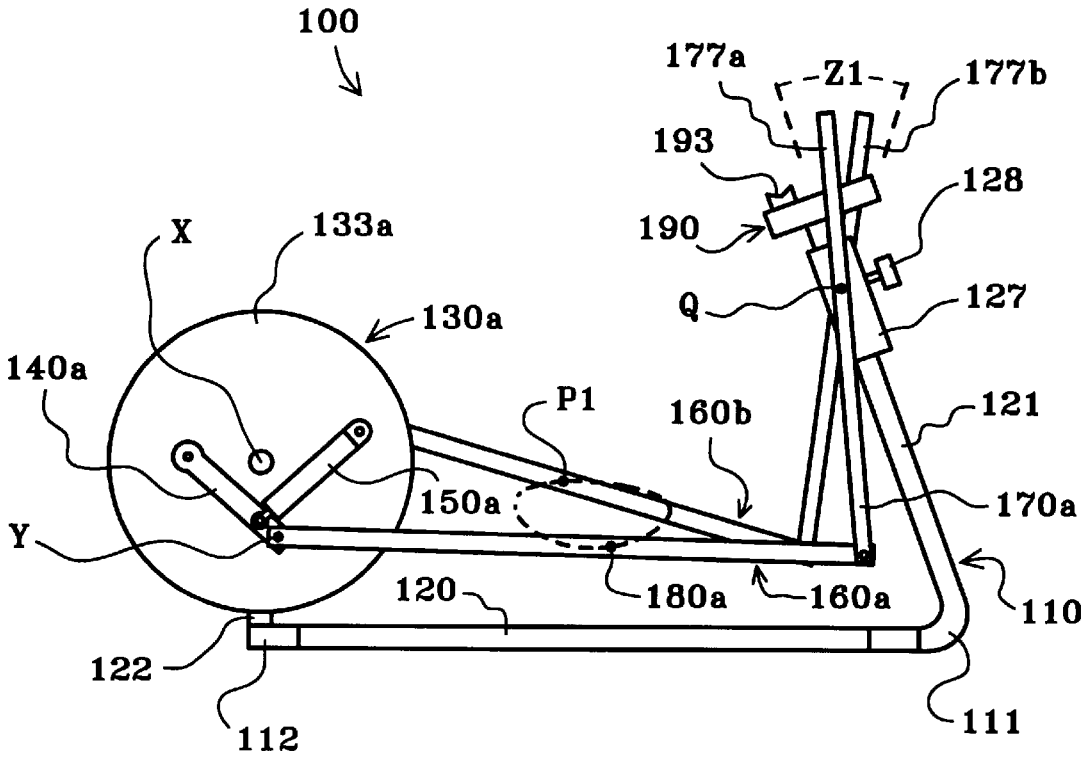
FIG. 1 is a right side view of an exercise apparatus constructed according to the principles of the present invention.

A first exercise apparatus constructed according to the principles of the present invention is designated as 100 in FIGS. 1–4. The exercise apparatus 100 generally includes a frame 110, adjustable length cranks 130*a* and 130*b* rotatably mounted on opposite sides of the frame 110, and linkage assemblies 160*a* and 160*b* movably interconnected between the frame 110 and respective cranks 130*a* and 130*b* and movable in a manner that links rotation of respective cranks 130*a* and 130*b* to generally elliptical motion of respective force receiving members 180*a* and 180*b*. The term "elliptical motion" is intended in a broad sense to describe a closed path of motion having a relatively longer first; axis and a relatively shorter second axis (which is perpendicular to the first axis).

The frame 110 generally includes a base 120 which extends from a first or forward end 111 to a second or rearward end 112. Transverse supports extend in opposite directions from each side of the base 120 at each of the ends 111 and 112 to stabilize the apparatus 100 relative to a floor surface. A first stanchion or upright portion 121 extends upward from the base 120 proximate the forward end 111. A second stanchion or upright portion 122 extends upward from the base 120 proximate the rearward end 112.

The embodiments of the present invention are generally symmetrical about a vertical plane extending lengthwise through the base (perpendicular to the transverse ends thereof), the primary exception being the relative orientation of certain parts on opposite sides of the plane of symmetry. In general, the "right-hand" parts are one hundred and eighty degrees out of phase relative to the "left-hand" counterparts. When reference is made to one or more parts on only one side of the apparatus, it is to be understood that corresponding part(s) are disposed on the opposite side of the apparatus. Those skilled in the art will also recognize that the portions of the frame which are intersected by the plane of symmetry exist individually and thus, do not have any "opposite side" counterparts. Moreover, any references to forward or rearward components or assemblies is merely for discussion purposes and thus, should not be construed as a limitation regarding how a machine or linkage assembly may be used or which direction a user must face.

Figure 3:
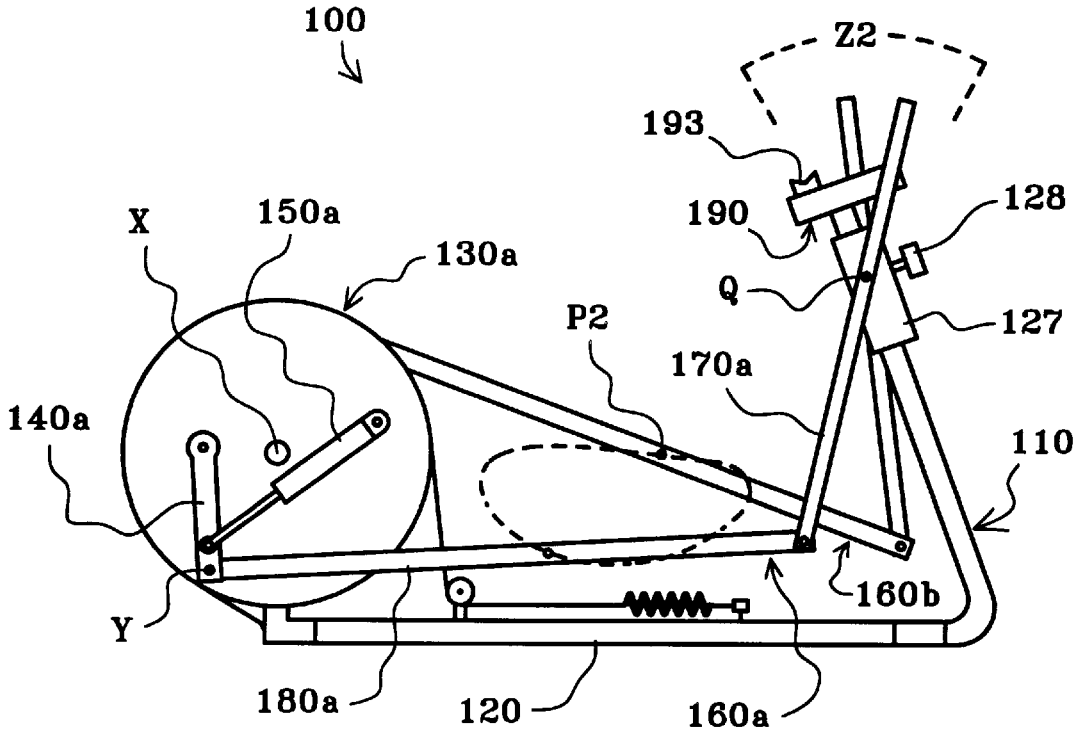
FIG. 3 is a right side view of the exercise apparatus of FIG. 1, shown in a second configuration.

On each side of the apparatus 100, an adjustable crank 130*a* or 130*b* is rotatably mounted to the rear stanchion 122 via a common shaft. In particular, each adjustable crank 130*a* or 130*b* includes a respective flywheel 133*a* or 133*b* which is rigidly secured to the crank shaft, so that each adjustable crank 130*a* or 130*b* rotates together with the crank shaft about a crank axis X relative to the frame 110. In FIG. 3, a drag strap 135 is shown disposed in tension about a circumferential groove on the flywheel 133*a* to resist rotation thereof. Those skilled in the art will recognize that other forms of resistance means may be added to or substituted for the drag strap 135 without departing from the scope of the present invention. Those skilled in the art will also recognize that the flywheels 133*a* and 133*b* may be described simply as members which rotate about the axis X, and further, that the flywheels may be replaced by pulleys, for example, which may or may not in turn by connected to a flywheel.

Each adjustable crank 130*a* or 130*b* further includes a respective second member 140*a* or 140*b* which has a first portion rotatably connected to a respective first member 133*a* or 133*b*. A second, discrete portion of each second member 140*a* or 140*b* is rotatably connected to a rearward portion of a respective foot supporting link 180*a* or 180*b*. These points of connection are designated as Y in FIGS. 1–4 and cooperate with the crank axis X to define a crank radius (measured linearly therebetween).

An opposite, forward portion of each foot supporting link 180*a* or 180*b* is rotatably connected to a lower end of a respective suspension link 170*a* or 170*b*. A relatively higher portion of each suspension link 170*a* or 170*b* is rotatably mounted relative to the forward stanchion 121, thereby defining pivot axis Q. Upper ends 177*a* and 177*b* of respective suspension links 170*a* and 170*b* are sized and configured for grasping by a person standing on the foot supporting links 180*a* and 180*b*. The links 170*a* and 180*a* and 170*b* and 180*b* cooperate to define respective right and left linkage assemblies 160*a* and 160*b*.

Those skilled in the art will recognize that other linkage assemblies may be substituted for those shown without departing from the scope of the invention. For example, certain prior art references suggest that a roller arrangement may be substituted for the suspension links on the apparatus 100. Those skilled in the art will also recognize that the suspension links 170*a* and 170*b* may be rotatably connected to a sleeve 127 which, in turn, is movably mounted on the forward stanchion 121 to facilitate changes in the inclination of foot exercise motion. On the embodiment 100 shown, a locking knob 128 is movable in a first direction to free the sleeve 127 for movement along the stanchion 121, and is movable in an opposite, second direction to lock the sleeve 127 in place at a desired height above the floor surface. Those skilled in the art will recognize that other adjustment assemblies, including a motorized lead screw, may be used in place of that shown in FIGS. 1–4.

Each adjustable length crank 130*a* or 130*b* also includes a third member 150*a* or 150*b* having a first portion rotatably connected to a third, discrete portion of a respective second member 140*a* or 140*b*, between the first portion and the second portion. A second, discrete portion of each third member 150*a* or 150*b* is rotatably connected to a respective first member 133*a* or 133*b*. Second members 140*a* and 140*b* and third members 150*a* and 150*b* are rotatably connected to respective first members 133*a* and 133*b* at generally diametrically opposed positions relative to the crank axis X. In this embodiment 100, the third members 150*a* and 150*b* are linear actuators of a type known in the art to adjust in length under certain conditions. When either third member 150*a* or 150*b* is retracted to minimal length, it extends substantially perpendicular to a respective second member 140*a* or 140*b*. Extension of either third member 150*a* or 150*b* causes a respective second member 140*a* or 140*b* to move generally away from the crank axis X, thereby increasing the effective crank radius.

In the embodiment 100, the actuators 150*a* and 150*b* are connected to a common controller 190 via standard electrical rotary joints interconnected between the stanchion 122 and respective flywheels 133*a* and 133*b*, and via wires disposed inside the frame 110. The wires extend from contacts mounted on the rearward stanchion 122 to the controller 190 mounted on top of the forward stanchion 121. A single input member 193 on the controller 190 is operable to change the length of both actuators 150*a* and 150*b*, although separate input members may be provided to facilitate discrete changes in the lengths of the actuators 150*a* and 150*b*, if so desired.

In the embodiment 100, the input member 193 is a switch which is pressed in a first direction to increase the length of both actuators 150*a* and 150*b*, and pressed in a second, opposite direction to decrease the length of both actuators 150*a* and 150*b*. Those skilled in the art will recognize that the switch could be replaced by other suitable input members, including a knob, for example, which rotates to change the length of the actuators and cooperates with indicia on the controller housing to indicate the current length of the actuators.

Figure 2:
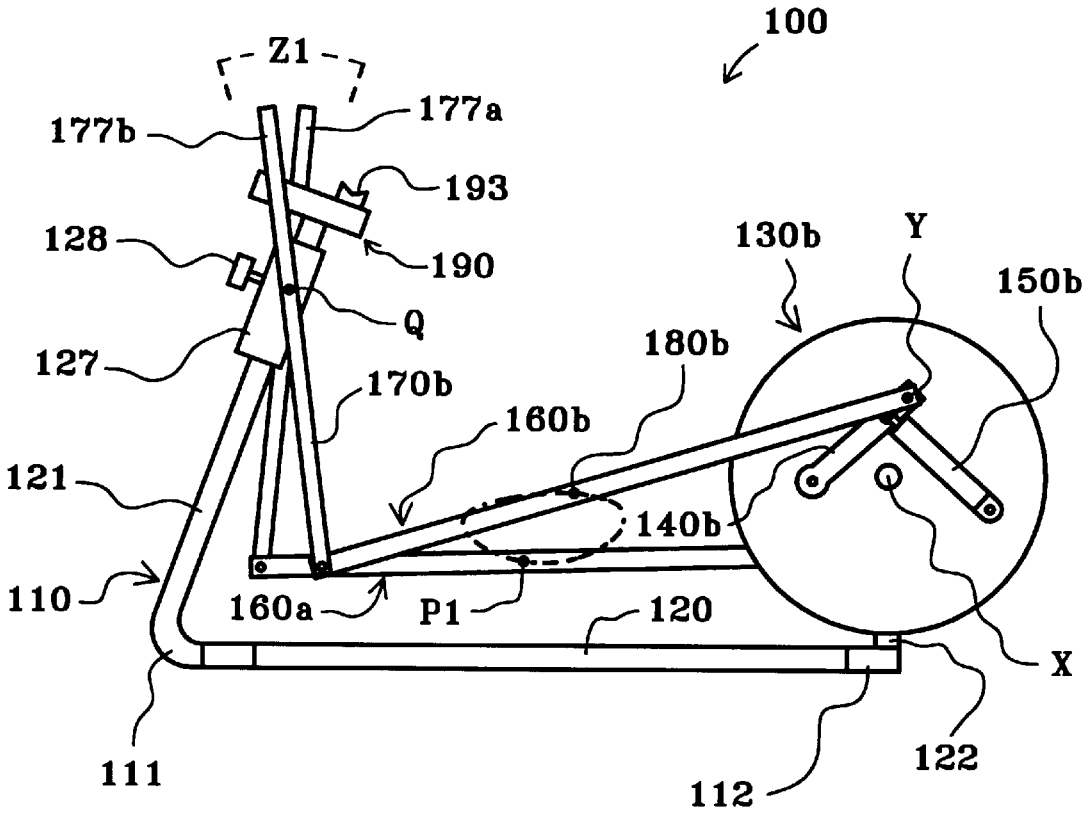
FIG. 2 is a left side view of the exercise apparatus of FIG. 1.
Figure 4:
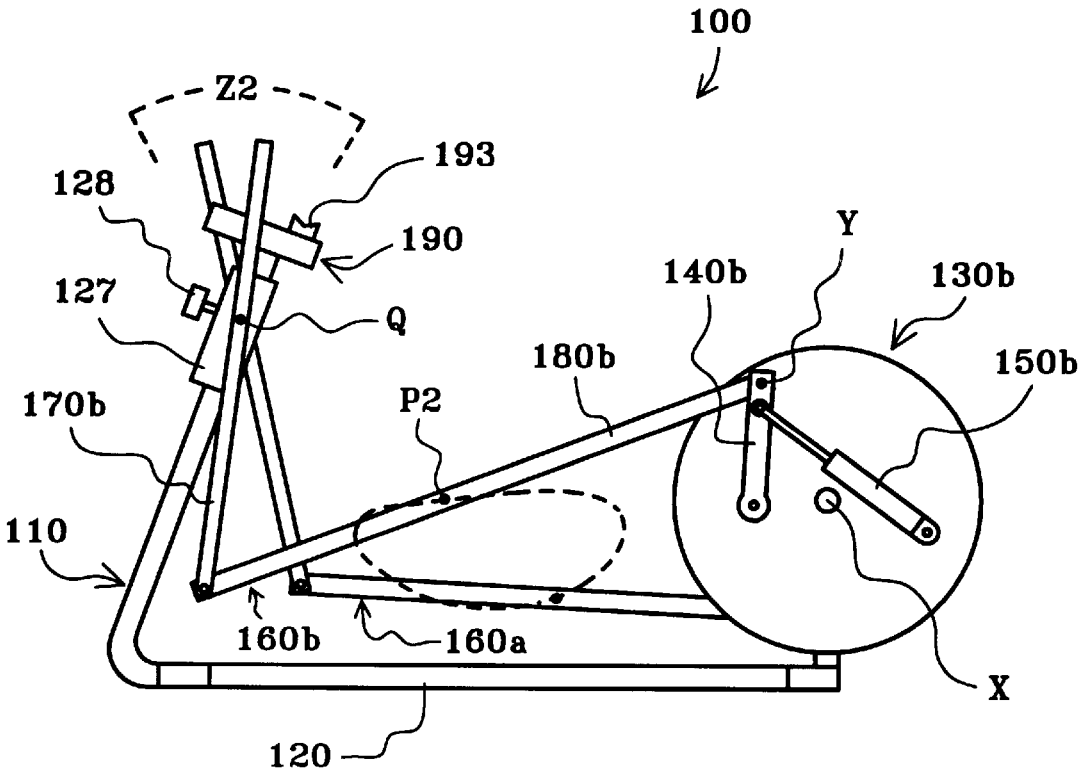
FIG. 4 is a left side view of the exercise apparatus of FIG. 1, shown in the same second configuration as in FIG. 3.

FIGS. 1–2 show points on the foot supporting links 180*a* and 180*b* traveling through first, relatively smaller paths P1 when the pivot axis Y is relatively closer to the crank axis X. FIGS. 3–4 show points on the foot supporting links 180*a* and 180*b* traveling through second, relatively larger paths P2 when the pivot axis Y is relatively farther from the crank axis X. Despite the change in size, the relatively larger paths P2 remain generally similar to the paths P1 in terms of both shape and orientation relative to the frame 110. The handles 177*a* and 177*b* similarly travel through relatively smaller paths Z1 when the pivot axis Y is relatively closer to the crank axis X, and through relatively larger paths Z2 when the pivot axis Y is relatively farther from the crank axis X.

The present invention may also be described with reference to various other assemblies and/or means for selectively adjusting the crank radius defined between the crank axis X and the pivot point Y. Those skilled in the art will recognize that such assemblies may be used on a machine similar to that shown in FIGS. 1–4, as well as on other crank driven exercise apparatus.

Figure 5:
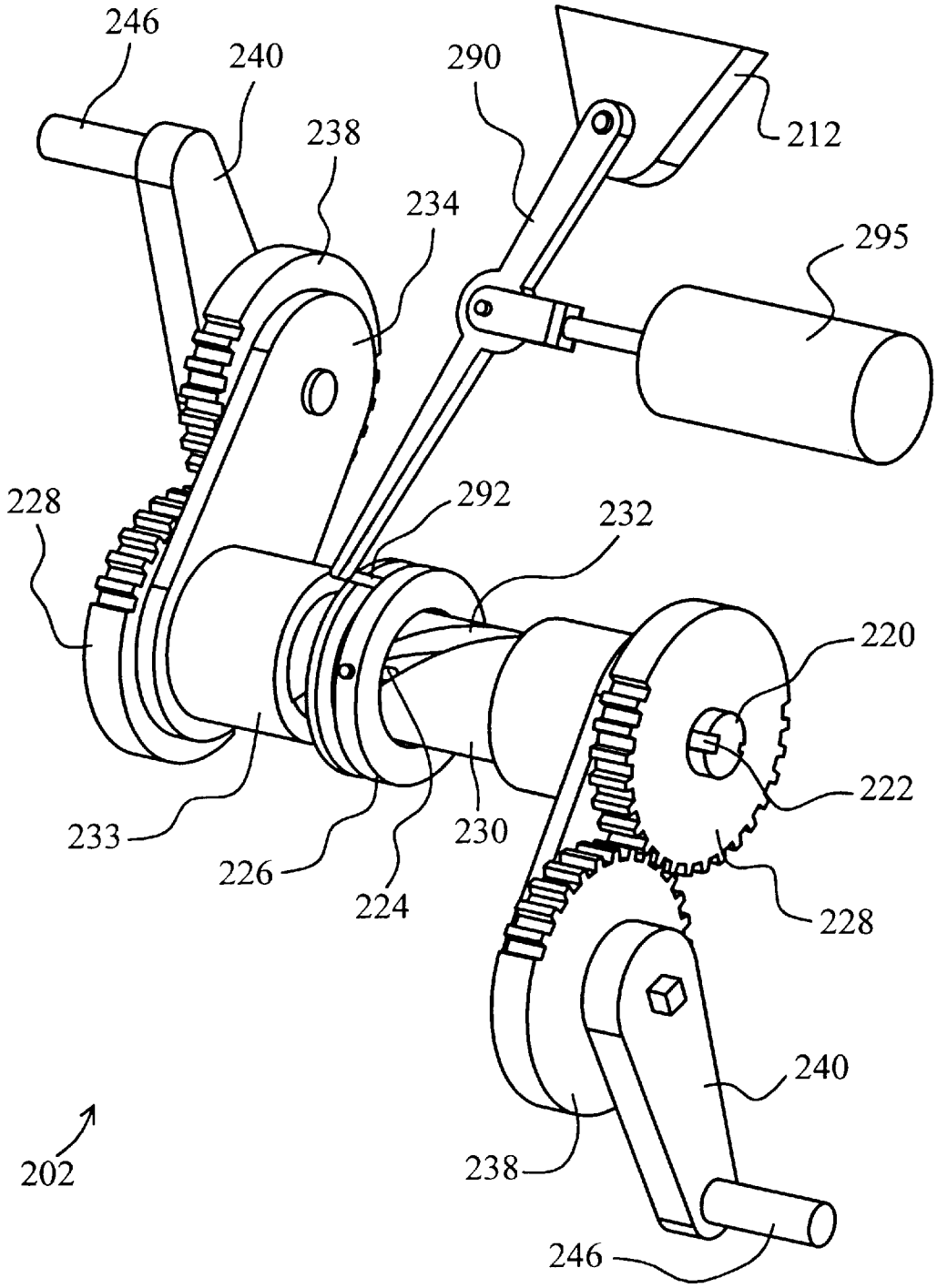
FIG. 5 is a perspective view of a second crank adjustment assembly constructed according to the principles of the present invention.
Figure 6:
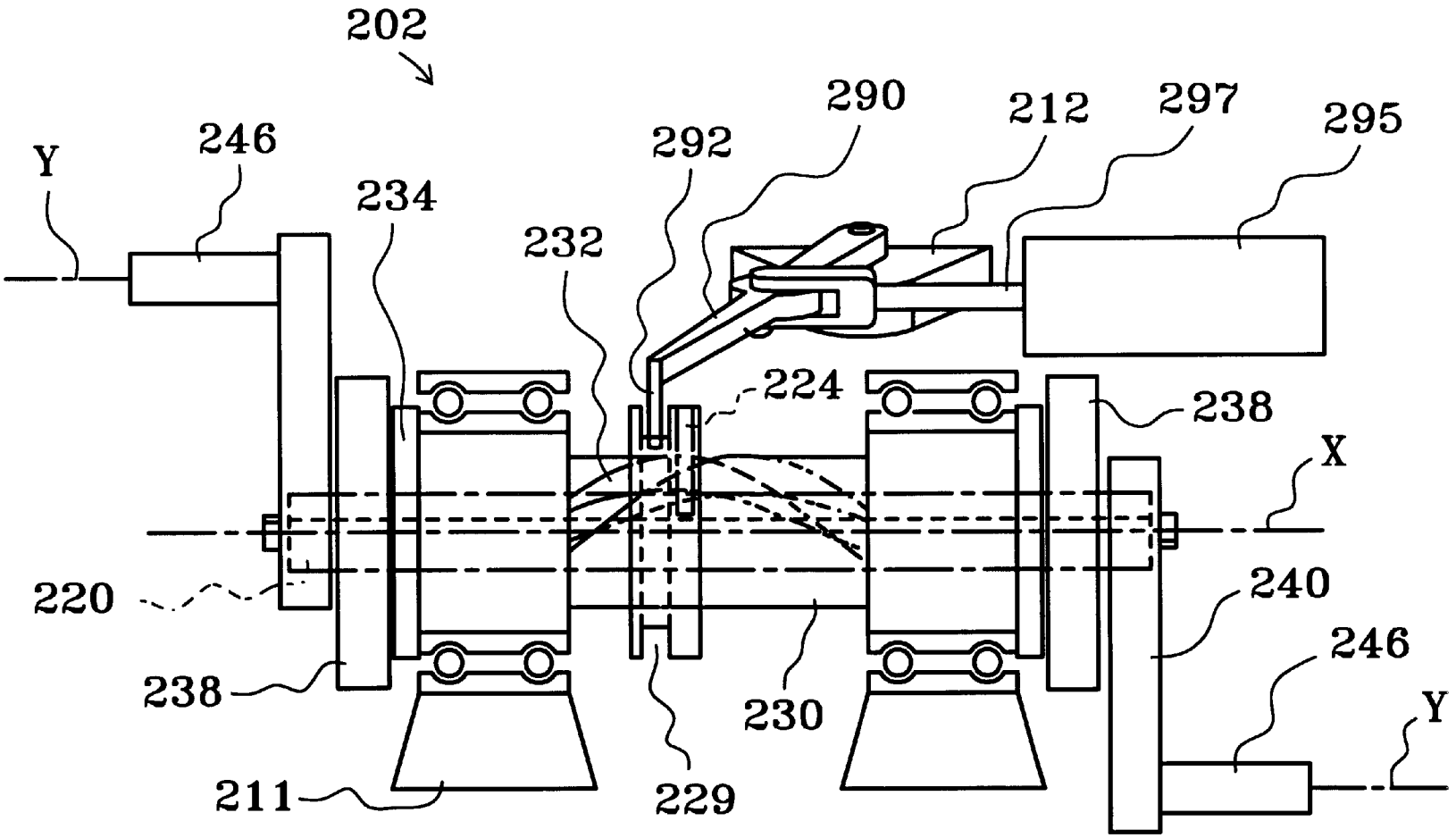
FIG. 6 is an end view of the crank adjustment assembly of FIG. 5.

A first alternative embodiment crank adjustment assembly is designated as 202 in FIGS. 5–10. As shown in FIG. 6, a shaft 220 rotates relative to a frame member 211 and defines the crank axis X. As shown in FIG. 5, the shaft 220 is disposed inside a cylindrical tube 230, and axially aligned gears 228 are rigidly secured to opposite, protruding ends of the shaft 220 (by welding, for example). An axially extending, linear slot 222 is formed in the shaft 220, and an axially extending, helical slot 232 is formed in the sleeve 230. A pin 224 extends through intersecting portions of the two slots 222 and 232 and is rigidly secured to a collar 226 disposed about the tube 230.

Bearing races or rings 233 are rigidly secured to opposite ends of the tube 230 (by welding, for example). Fixed arms 234 are rigidly secured to respective stops 233 and extend radially in opposite directions from the crank axis X. Orbiting gears 238 are rotatably mounted on distal ends of respective fixed arms 234 and linked to respective axially aligned gears 228 by interengaging teeth. Pivot arms 240 are keyed to respective orbiting gears and extend in opposite directions from one another. Crank pins 246 extend axially away from respective pivot arms 240 and are sized and configured to support respective foot supporting links.

During steady state operation, the pin 224 constrains the tube 230 and the shaft 220 to rotate together about the crank axis. Also, the gears 228 and 238 remain fixed relatively to one another, and the crank pins 246 to rotate at a fixed radius about the crank axis X. When adjustment to the crank radius is desired, the collar 226 and pin 224 are moved axially relative to the tube 230 and the shaft 220. Axially movement of the pin 224 causes the tube 230, the fixed arms 234, the orbiting gears 238, and the pivot arms 240 to rotate relative to the shaft 220, which in turn, causes the orbiting gears 238 and the pivot arms 240 to rotate relative to their respective fixed arms 234. Rotation of the cranks pins 246 away from the crank axis X increases the effective crank radius, and rotation of the crank pins 246 toward the crank axis X decreases the effective crank radius.

A circumferential channel or groove 229 is provided on the collar 226 to receive a distal end 292 of an adjustment arm 290. An opposite end of the adjustment arm 290 is rotatably connected to a frame member 212. A linear actuator (or other conventional moving means) 295 is interconnected between an intermediate portion of the adjustment arm 290 and a discrete portion of the frame. During steady state operation, the actuator 295 remains inactive, and the distal end 292 of the adjustment arm 290 rests within the groove 229 in the collar 226. When adjustment to the crank radius is desired, the actuator 295 forces the distal end 292 of the adjustment arm 290 against one of the sidewalls of the groove 229 to move the collar 226 axially.

FIGS. 7–10 show an exercise apparatus 200 which incorporates the crank adjustment assembly 202 of FIGS. 5–6. The apparatus 200 has an I-shaped base 210 designed to rest upon a floor surface; a crank shaft 220 rotatably mounted to a stanchion extending upward from a rear end of the base 210; a rigid, foot supporting link 260 having a rear end rotatably connected to the crank pin 246, and a front end constrained to move in reciprocating fashion relative to the base 210; a rigid, L-shaped handle bar 270 rotatably mounted to a stanchion extending upward from a front end of the base 210; and a rigid intermediate link 276 rotatably interconnected between the front end of the foot supporting link 260 and the lower end of the handle bar 270. The opposite, upper end of the handle bar 270 is sized and configured for grasping.

The handle bar 270 and the forward stanchion cooperate to define a first pivot axis A. The handle bar 270 and the intermediate link 276 cooperate to define a second pivot axis B which moves in an arc about the first pivot axis A. A stop 277 is mounted on the forward stanchion to limit forward pivoting of the second pivot axis B. The intermediate link 276 and the foot supporting link 260 cooperate to define a third pivot axis C which pivots about the second pivot axis B. The foot supporting link 260 cooperates with the crank pin 246 to define a fourth pivot axis Y which rotates about the crank axis X.

When the handle bar 270 is resting against the stop 277 and the crank is set at a relatively smaller radius, the center of a person's foot F and underlying foot supporting link 260 move through the generally elliptical path shown in FIG. 7. When the handle bar 270 is resting against the stop 277 and the crank is set at a relatively larger radius, the center of a person's foot F and underlying foot supporting link 260 move through the generally elliptical path shown in FIG. 9. As suggested by FIGS. 8 and 10, a person may pull rearward on the handle bars 270 to elevate the forward ends of the foot paths and carry a portion of his weight during exercise.

A third crank adjustment assembly is designated as 303 in FIGS. 11–12. In this assembly 303, a wheel 330 rotates relative to a frame member 311 to define the crank axis X. The central portion of a unitary crank 340 is mounted on the wheel 330 and rotatable relative thereto about a second axis S which is skewed relative to the crank axis X. Distal portions of the crank 340 extend in non-linear fashion in opposite directions from the wheel 330. Distal ends of the crank 340 are connected to respective foot supporting links 360 by means of universal joints 346. The arrangement is such that rotation of the crank 340 relative to the wheel 330 (by a motor 380, for example) adjusts each crank radius defined between the crank axis X and an interconnection point Y. For example, the crank radius shown in FIG. 11 is less than the crank radius shown in FIG. 12.

Figure 13:
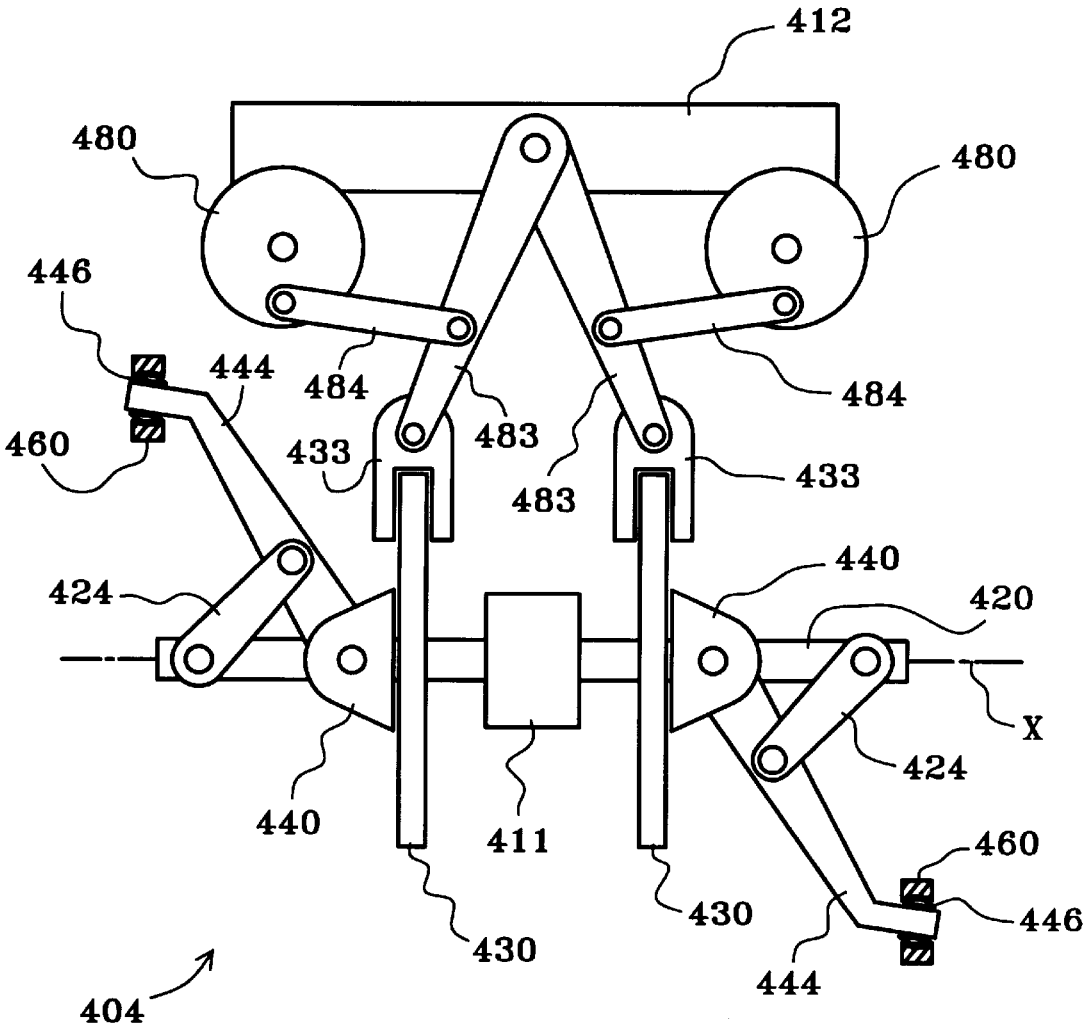
FIG. 13 is a top view of a fourth crank adjustment assembly constructed according to the principles of the present invention.

On a fourth crank adjustment assembly, designated as 404 in FIG. 13, a crank shaft 420 rotates relative to a frame member 411 to define the crank axis X. Left and right flywheels 430 are mounted on the shaft 420 to rotate together therewith and move axially relative thereto. Left and right pivot bushings 440 are mounted on respective flywheels 430 (by welding, for example) and likewise rotate together with the shaft 420 and move axially relative thereto. First ends of left and right crank arms 444 are rotatably connected to respective pivot bushings 440, and second, opposite ends are connected to respective foot supporting links 460 by means of spherical bearings 446. First ends of left and right links 424 are rotatably mounted to respective ends of the crank shaft 420, and second, opposite ends are rotatably connected to intermediate portions of respective crank arms 444.

Left and right arms 483 have first ends connected to a frame member 412 and pivotal about a common axis relative thereto, and second ends connected to respective left and right bearing assemblies 433 and pivotal about parallel axes relative thereto. Each bearing assembly 433 engages opposite sides of a respective flywheel 430. First ends of left and right links 484 are rotatably connected to intermediate portions of respective arms 483, and second, opposite ends are rotatably connected to respective left and right rollers 480. The rollers are mounted on the frame member 412 and selectively rotated in opposite directions to pull the arms 483 apart or push the arms 483 together and thereby move respective flywheels 430 and pivot bushings 440 to adjust the crank radius on each side of the assembly 404.

Figure 14:
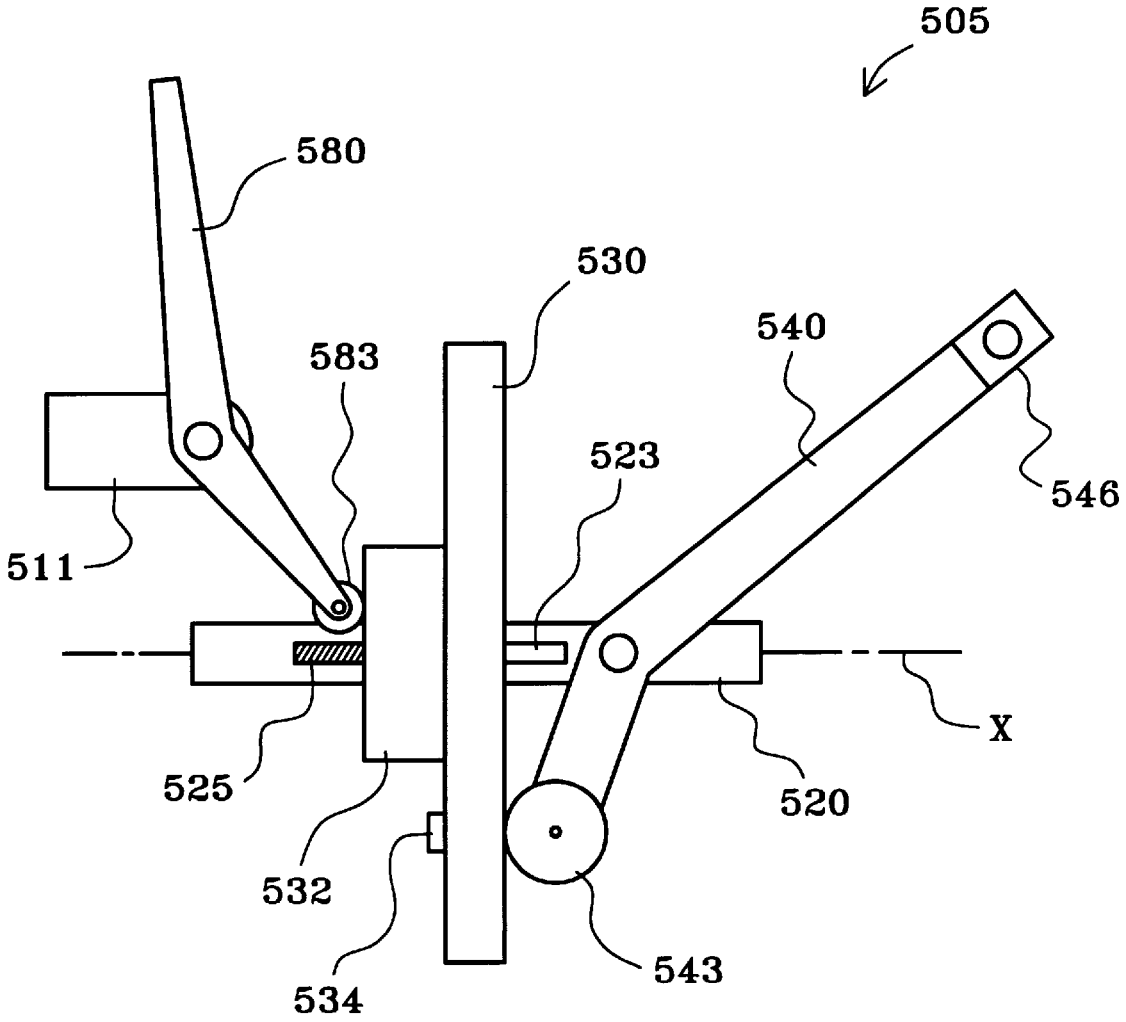
FIG. 14 is a top view of a fifth crank adjustment assembly constructed according to the principles of the present invention.

On a fifth crank adjustment assembly, designated as 505 in FIG. 14, a crank shaft 520 rotates relative to a frame to define the crank axis X. On each side of the assembly 505, a flywheel 530 is mounted on the shaft 520 to rotate together therewith and move axially relative thereto. A bearing member 532 is similarly mounted on the shaft 520 to rotate together therewith and move axially relative thereto (by means of a slot 523 in the shaft 520). A first end of a crank arm 540 supports a roller 543 which bears against the flywheel 530; a second, opposite end of the crank arm 540 is connected to a foot supporting link by means of a universal joint 546; and an intermediate portion is mounted on the shaft 520 and rotatable relative thereto about an axis extending perpendicular to the crank axis X. A bolt 534 extends through a radially extending slot in the flywheel 530 and threads into the roller 543 to axially link the flywheel 530 and the first end of the crank arm 540.

A first end of a lever 580 supports a roller 583 which bears against a side of the bearing member 532 opposite the flywheel 530; a second end is connected to a conventional actuator; and an intermediate portion is rotatably connected to a frame member 511. Rotation of the lever 580 moves the bearing member 532 and the flywheel 530 axially along the crank shaft 520, thereby causing the crank arm 540 to pivot relative to the crank shaft 520 and define a different crank radius. A spring 525 is disposed in tension between the shaft 520 and the bearing member 532 to bias the latter toward the lever 580.

Figure 15:
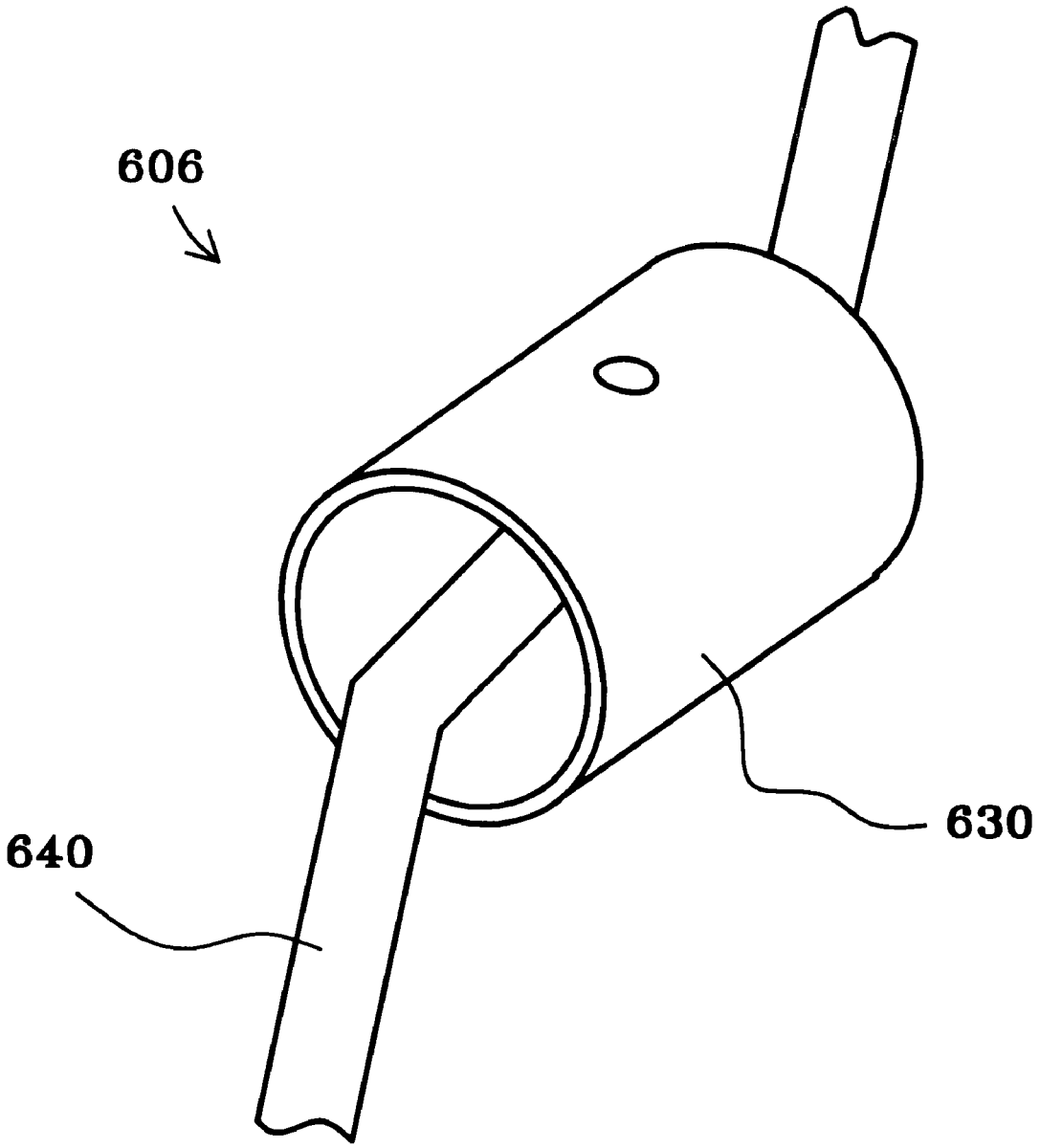
FIG. 15 is a diagrammatic perspective view of a sixth crank adjustment assembly constructed according to the principles of the present invention.
Figure 16:
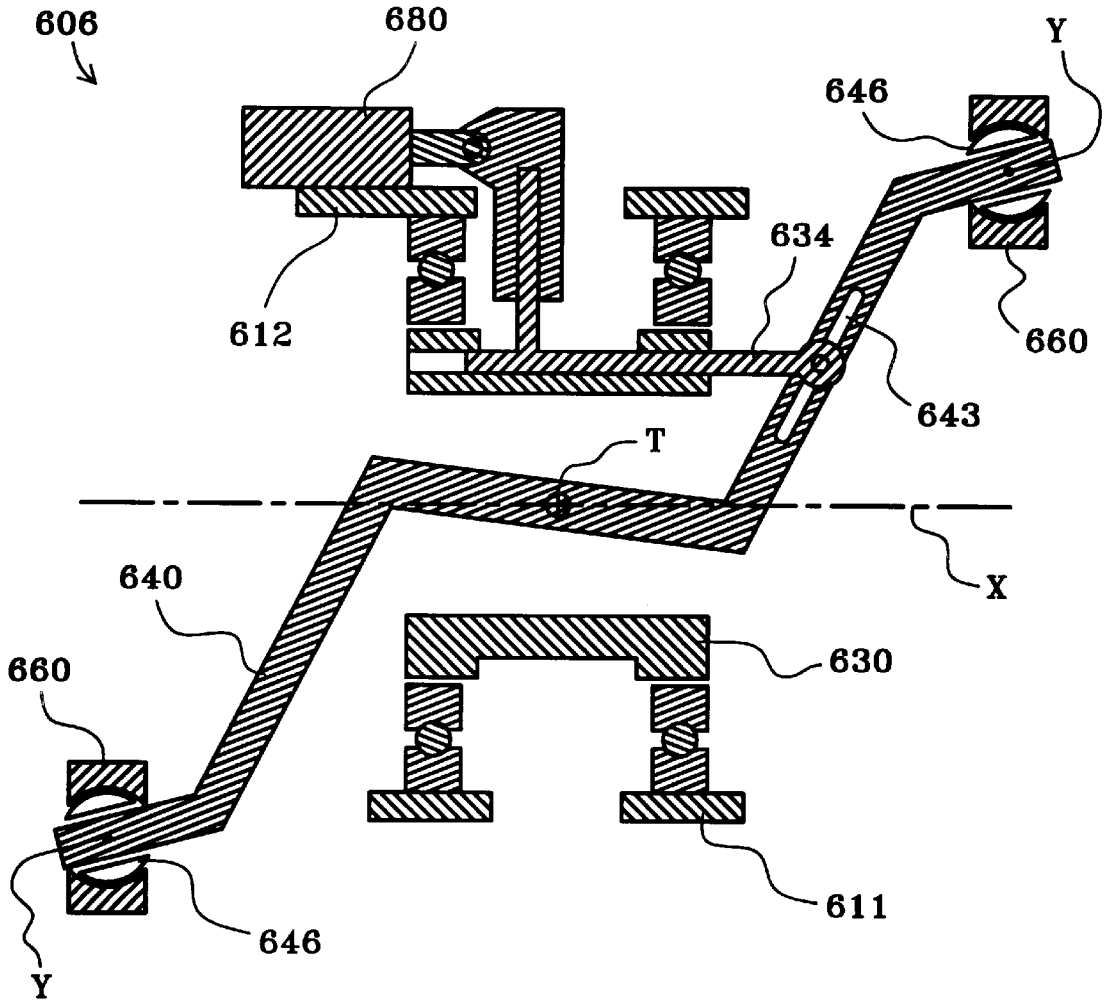
FIG. 16 is a sectioned top view of the crank adjustment assembly of FIG. 15.

On a sixth crank adjustment assembly, designated as 606 in FIGS. 15–16, a tube 630 rotates relative to a frame member 611 to define the crank axis X. The central portion of a unitary crank 640 is mounted within the tube 630 and rotatable together therewith about the crank axis X and rotatable relative thereto about a second axis T which extends perpendicular to the crank axis X. Distal portions of the crank 640 extend in non-linear fashion in opposite directions from the tube 630. Distal ends of the crank 640 are connected to respective foot supporting links 660 by means of universal joints 646. The arrangement is such that rotation of the crank 640 relative to the tube 630 adjusts each crank radius defined between the crank axis X and each point of interconnection Y.

Adjustments to the crank radii may be effected by providing a member 634 on the tube 630 which slides in an axial direction relative thereto. An end of the sliding member 634 engages a race 643 in one of the distal crank portions and thereby imparts turning force on the crank 630 (about the axis T). In FIG. 16, clockwise rotation of the crank 640 results in relatively smaller crank radii. A radially displaced portion of the sliding member 634 is connected to a first end of a conventional actuator 680, and a second, opposite end of the actuator 680 is connected to a frame member 612. The actuator 680 extends parallel to the crank axis X and selectively expands and contracts to move the sliding member 634 axially along the tube 630.

Figure 17:
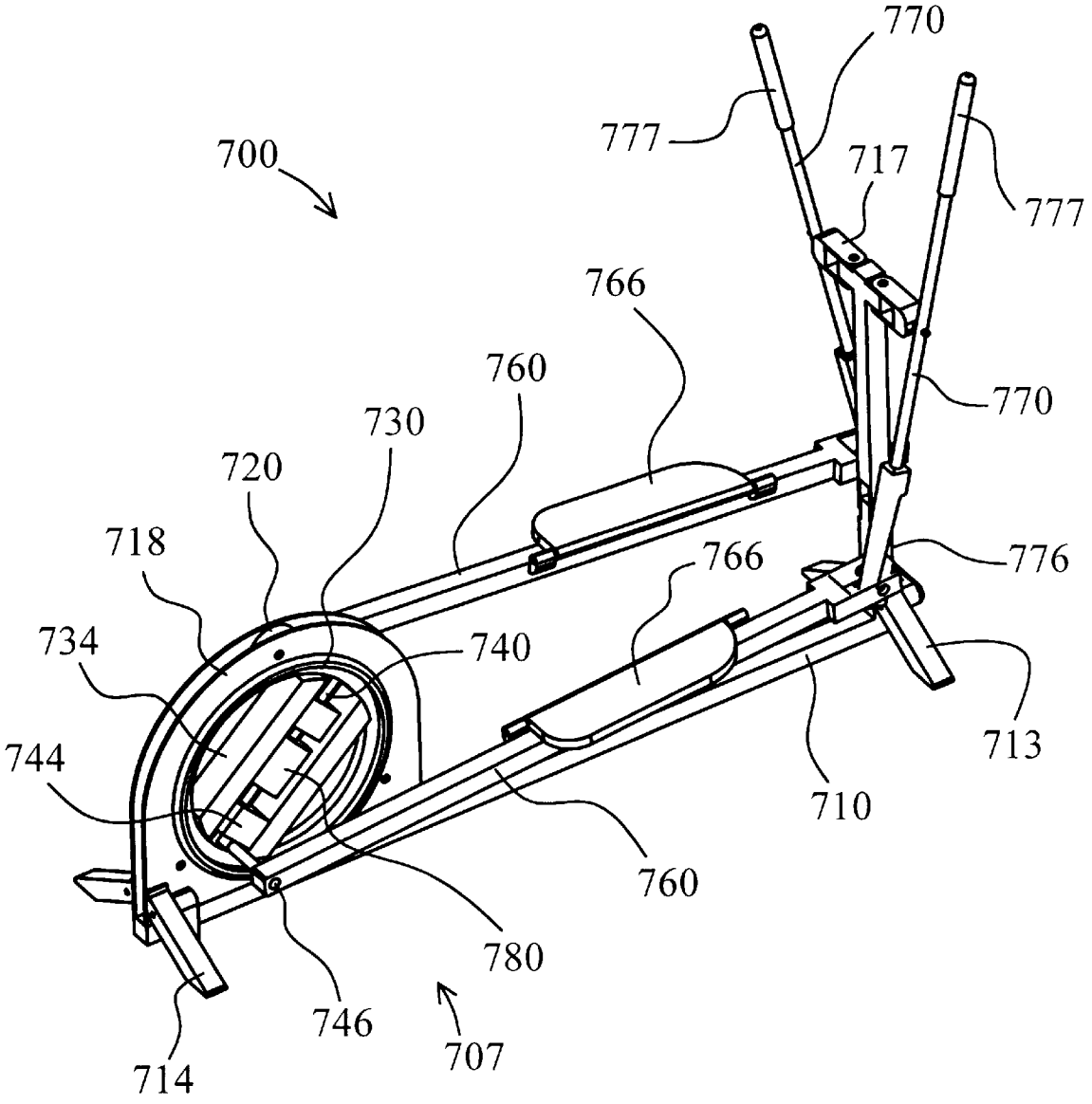
FIG. 17 is a perspective view of an exercise apparatus incorporating another crank adjustment assembly constructed according to the principles of the present invention.

Another exercise apparatus constructed according to the principles of the present invention is designated as 700 in FIG. 17. In addition to providing a selectively adjustable crank assembly 707, the apparatus 700 is foldable into a relatively flat or low profile storage configuration. The apparatus generally includes a base 710 having front and rear lateral supports 713 and 714 which are movable between the extended positions shown in FIG. 17 and retracted positions in which they extend generally perpendicular to the floor (when the machine 700 occupies the position shown in FIG. 17).

Parallel flanges 718 extend upward from the rear of the base 710, and at least three rollers 720 are rotatably interconnected therebetween. The rollers 720 cooperate to support the circumferential rim of a flywheel 730. A lead screw 740 is rotatably mounted between diametrically opposed portions of the flywheel rim, and parallel braces 734 extend between discrete portions of the flywheel rim on opposite sides of the lead screw 740. A motor 780 is mounted between central portions of the braces 734 and connected to the lead screw 740 in such a manner that operation of the motor 780 is linked to rotation of the lead screw 740. Blocks 744 are threaded onto the lead screw 740 on opposite sides of the motor 780 and disposed between the braces 740. The blocks 744 are threaded in such a manner that rotation of the lead screw 740 causes the blocks to move radially in opposite directions relative to one another.

Crank pins 746 extend axially away from respective blocks 744 and rotatably support rear ends of respective foot supporting links 760. Foot platforms 766, each sized and configured to support a respective foot, are rotatably mounted to intermediate portions of respective foot supporting links 760. The foot platforms 766 are movable between the extended positions shown in FIG. 17 and retracted positions in which they extend generally perpendicular to the floor (when the machine 700 occupies the position shown in FIG. 17).

The front ends of the foot supporting links 760 are rotatably connected to lower ends of handle bar links 770. In particular, a generally J-shaped hook 776 on each handle bar link 770 cradles a pin on a respective foot supporting link 760. The pins are removable from the hooks 776 to facilitate folding of the machine 700 for storage purposes. An intermediate portion of each handle bar link 770 is rotatably mounted to a forward stanchion, and an upper end 777 of each handle bar link 770 is sized and configured for grasping. Pivoting frame members 717 allow the handle bar links 770 to be selectively folded toward one another about axes extending perpendicular to the floor (when the machine 700 occupies the position shown in FIG. 17). Also, the stanchion selectively rotates relative to the base 710 about an axis extending parallel to the floor (when the machine 700 occupies the position shown in FIG. 17) for storage purposes.

Figure 18:
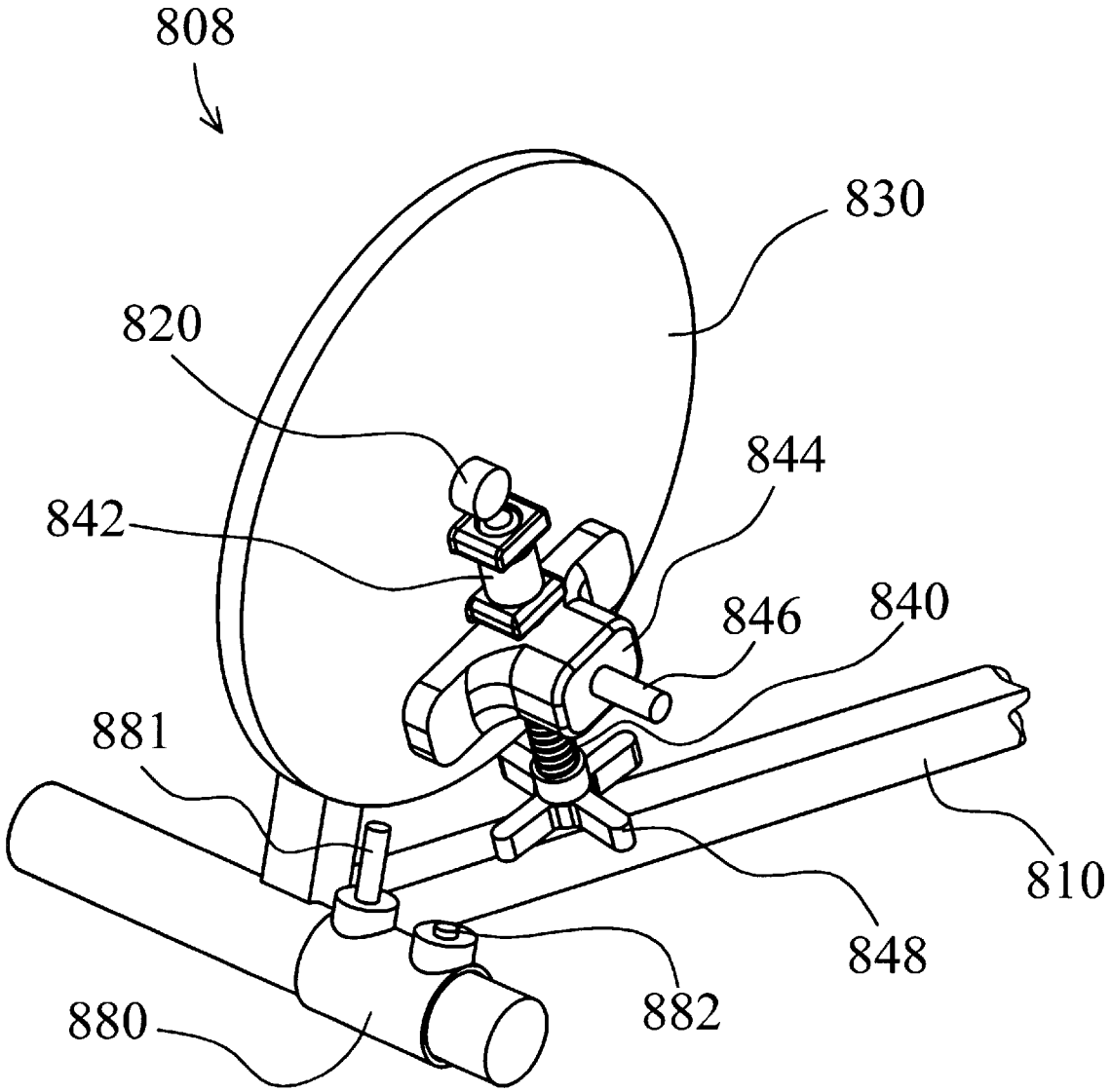
FIG. 18 is a perspective view of yet another crank adjustment assembly constructed according to the principles of the present invention.

Yet another crank adjustment assembly constructed according to the principles of the present invention is designated as 808 in FIG. 18. On this embodiment 808, a flywheel 830 is rotatably mounted relative to a base 810 by means of a crank shaft 820. A radially inward end of a lead screw 840 is rotatably mounted on the flywheel 830 by means of a fastener 842, and a knob 848 is rigidly secured to an opposite, radially outward end of the lead screw 840. A block 844 is disposed on the lead screw 840 between the fastener 842 and the knob 848, and adjacent the flywheel 830. A crank pin 846 extends axially outward from the block 844 to support a foot supporting link. The crank pin 846 and the crank shaft 820 cooperate to define a crank radius, and rotation of the knob 848 and lead screw 840 causes the block 844 and pin 846 to move radially relative to the crank shaft 820, thereby adjusting the crank radius.

A remotely operated adjustment assembly 880 is mounted on the base 810 generally beneath the crank shaft 820. The assembly 880 includes first and second solenoid plunger (or other actuators) 881 and 882 which function to selectively rotate the knob 848 in opposite directions. The solenoid plungers 881 and 882 are disposed on opposite sides of a plane intersecting the longitudinal axis of the lead screw 840 and extending perpendicular to the crank shaft 820. When the first plunger 881 is extended, as shown in FIG. 18, it imparts a moment force against the knob during rotation of the flywheel 830 and thereby causes the knob to rotate in a first direction. When the second plunger 882 is extended (and the first plunger 881 is not), the second plunger 882 imparts an opposite moment force against the knob during rotation of the flywheel 830 and thereby causes the knob to rotate in a second, opposite direction. Indexing of the knob rotation may be controlled by a detent arrangement, for example. Also, the plungers 881 and 882 may be controlled by a computer program and/or at the discretion of a user.

Figure 19:
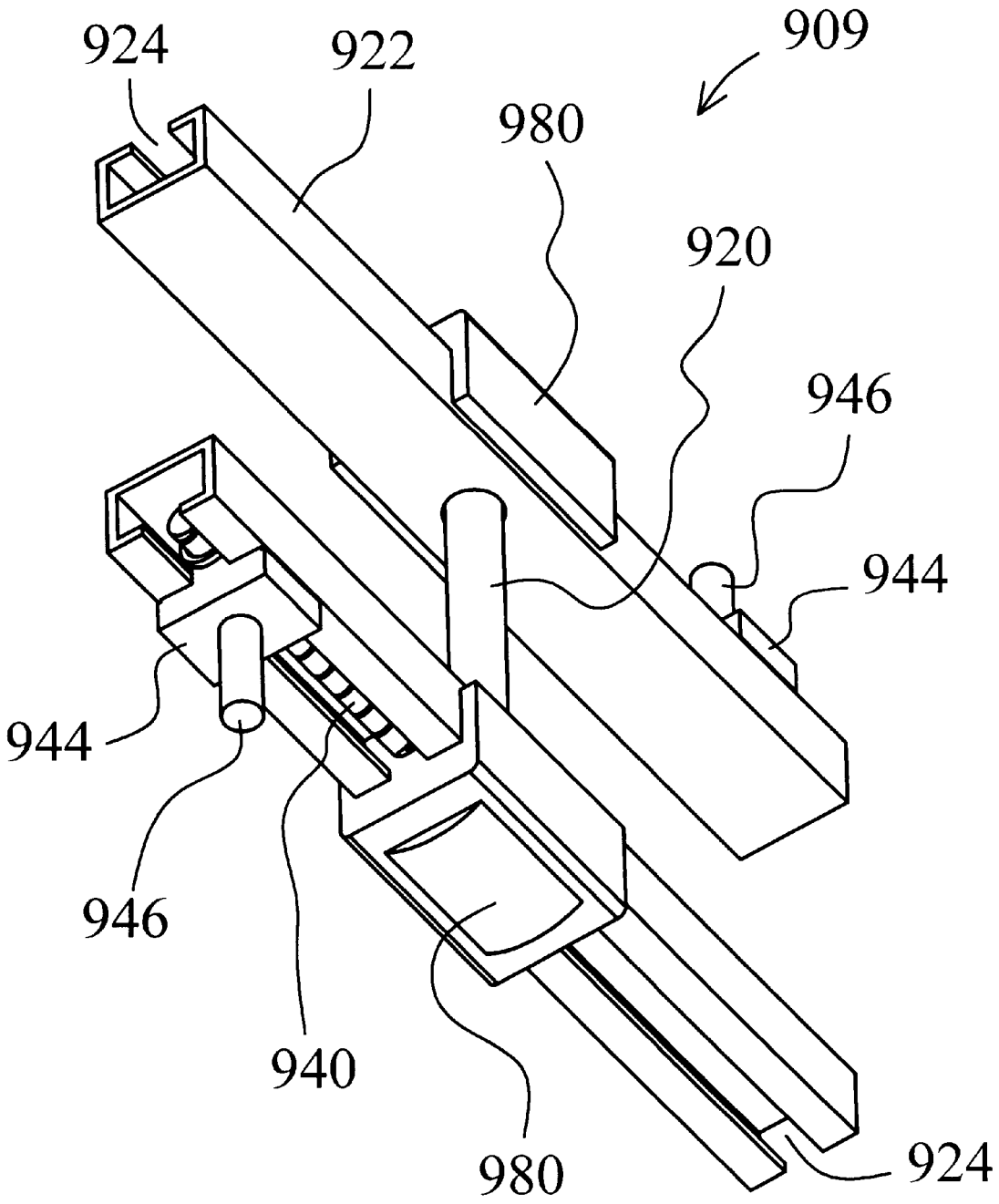
FIG. 19 is a perspective view of still another crank adjustment assembly constructed according to the principles of the present invention.

Still another embodiment of the present invention is designated as 909 in FIG. 19. This embodiment 909 is similar in some respects to each of the two previous embodiments 707 and 808. Left and right rails 922 are rigidly connected to opposite ends of a crank shaft 920 and extend radially. Left and right motors 980 are aligned with opposite ends of the crank shaft 920 and rigidly connected to respective rails 922. Left and right lead screws 940 are disposed within respective rails 922 and selectively rotated by respective motors 980. Left and right blocks 944 are disposed within respective rails 922 and threaded onto respective lead screws 940. Left and right crank pins 946 extend axially outward from respective block 944 to support respective foot supporting links. The crank pins 946 and the crank shaft 920 cooperate to define a crank radius, and operation of the motors 980 causes the blocks 944 and 946 to move radially relative to the crank shaft 920, thereby adjusting the crank radius.

Figure 20:
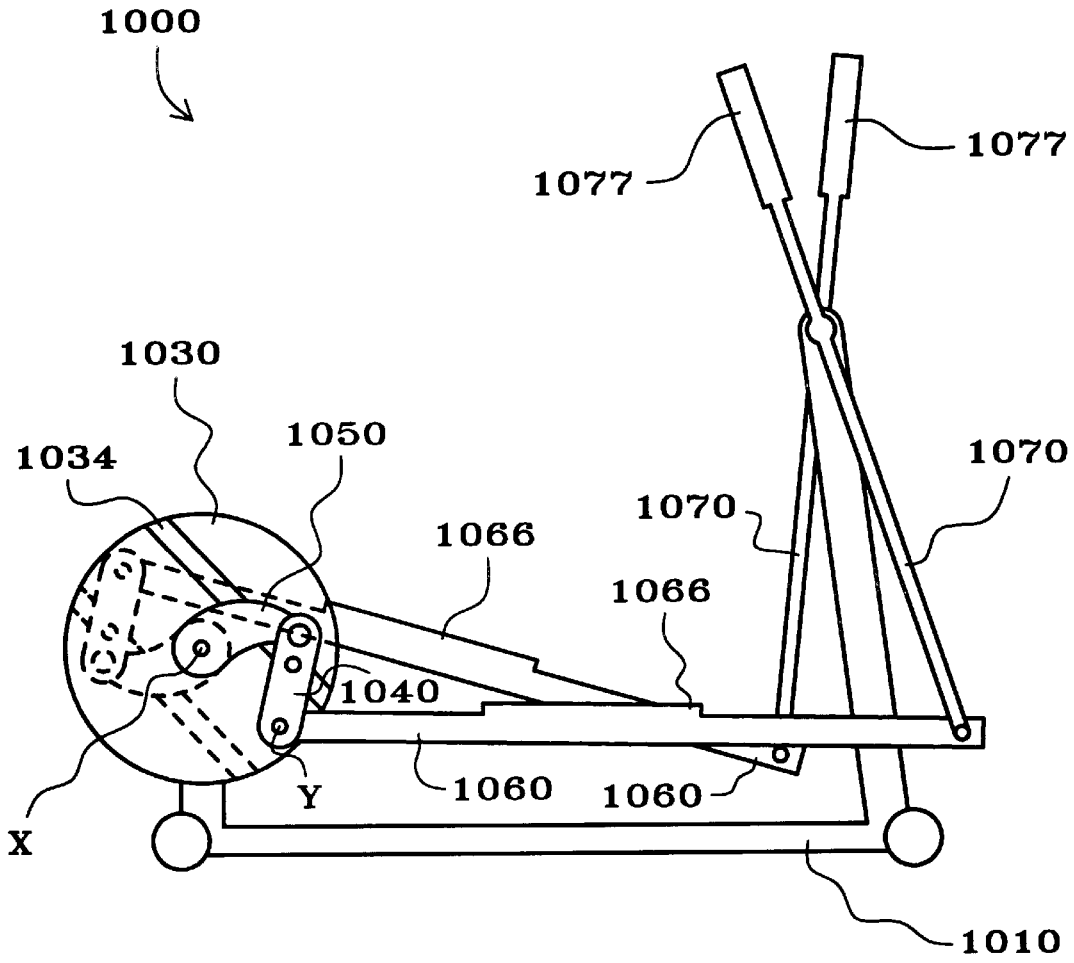
FIG. 20 is a side view of an exercise apparatus incorporating one more crank adjustment assembly constructed according to the principles of the present invention.

FIG. 20 shows an exercise apparatus 1000 which embodies another possible variation of the present invention. The apparatus 1000 includes a frame 1010 having a floor engaging base and stanchions extending upward from opposite ends of the base 1010. A flywheel 1030 is rotatably mounted on the rearward stanchion and rotates relative thereto about an axis X. Linear grooves or races 1034 are formed in opposite sides of the flywheel 1030. The races 1034 may be described as parallel to one another and diametrically opposed relative to the flywheel axis X. Actuator arms 1050 are disposed on opposite sides of the flywheel 1030 and are selectively rotatable relative thereto about the axis X.

Crank arms 1040 are disposed on opposite sides of the flywheel 1030. Each crank arm 1040 has a first end rotatably connected to a respective actuator arm 1050, an intermediate portion constrained to travel along a respective race 1034, and a second end rotatably connected to an end of a respective foot supporting link 1060. An intermediate portion 1066 of each foot supporting link 1060 is sized and configured to support a person's foot, and an opposite end of each foot supporting link is constrained to move in reciprocal fashion relative to the frame 1010.

On the embodiment 1000, the forward end of each foot supporting link 1060 is rotatably connected to a lower end of a rocker link 1070. An intermediate portion of each rocker link 1070 is rotatably connected to the forward stanchion on the frame 1010, and an upper end 1077 of each rocker link 1070 is sized and configured for grasping. Those skilled in the art will recognize that other arrangements, such as a roller and ramp combination, may be substituted for the rocker links without departing from the scope of the present invention.

The apparatus 1000 is configured so that rotation of the flywheel 1030 is linked to generally elliptical motion of the foot supporting members 1066. During steady state operation, the actuator arms 1050 rotate together with the flywheel 1030 and cooperate with the races 1034 to maintain the crank pins (see axis Y) at a fixed distance from the flywheel axis X. When an adjustment in crank radius is desired, the actuator arms 1050 are rotated relative to the flywheel 1030 to reorient the crank arms 1040 relative thereto.

One suitable means for selectively rotating the actuator arms 1050 is designated as 202 in FIGS. 5–6. In the alternative, the crank arms 1040 may be adjusted by means of a fastener interconnected between one of the crank arms 1040 and the flywheel 1030. For example, the fastener may be a spring-loaded pin which is inserted through the crank arm 1040 and slot 1034 and into one of a plurality of holes in the base wall of the slot 1034. A lever may be connected to the pin and accessible to a person standing on the foot supports 1066. A force applied against the lever (by the person's respective foot, for example) may pull the pin outward and thereby allow rotation of the crank arms 1040 and actuator arms 1050 relative to the flywheel 1030, until the spring urges the pin into the next available hole in the base wall of the slot 1034.

The foregoing description sets forth only some of the numerous possible embodiments of the present invention and will lead those skilled in the art to recognize additional embodiments, modifications, and/or applications which fall within the scope of the present invention. Accordingly, the scope of the present invention is to be limited only to the extent of the claims which follow.

What is claimed is:

1. A method of exercising on an exercise machine of the type having a frame, left and right cranks supported at one end of the frame and rotatable relative thereto about a common crank axis, and left and right foot supporting links having respective first ends movably connected to respective cranks and respective second ends supported at an opposite end of the frame and movable in reciprocal fashion relative thereto, wherein rotation of the cranks is linked to generally elliptical movement of intermediate portions of the foot supporting links, comprising the steps of:

standing with a respective foot on each said foot supporting link;

moving the foot supporting links through respective elliptical paths having a first configuration;

moving a single member on the exercise machine to both (i) move a point of interconnection between the left foot supporting link and the left crank relative to the crank axis; and (ii) move a point of interconnection between the right foot supporting link and the right crank relative to the crank axis; and subsequently moving the foot supporting links through respective elliptical paths having a second, discrete configuration.

2. A method of exercising on an exercise machine of the type having a frame, left and right cranks supported at one end of the frame and rotatable relative thereto about a common crank axis, and left and right foot supporting links having respective first ends movably connected to respective cranks and respective second ends supported at an opposite end of the frame and movable in reciprocal fashion relative thereto, wherein rotation of the cranks is linked to generally elliptical movement of intermediate portions of the foot supporting links, comprising the steps of:

while standing with a respective foot on each said foot supporting link, simultaneously relocating (i) a point of interconnection between the left foot supporting link and the left crank relative to the crank axis; and (ii) a point of interconnection between the right foot supporting link and the right crank relative to the crank axis; and moving the foot supporting links through respective elliptical paths having a configuration dependent upon the relocating step.

3. A method of exercising on an exercise machine of the type having a frame, left and right cranks supported at one end of the frame and rotatable relative thereto about a common crank axis, and left and right foot supporting links having respective first ends movably connected to respective cranks and respective second ends supported at an opposite end of the frame and movable in reciprocal fashion relative thereto, wherein rotation of the cranks is linked to generally elliptical movement of intermediate portions of the foot supporting links, comprising the steps of:

standing with a respective foot on each said foot supporting link;

moving the foot supporting links through respective elliptical paths having a first configuration;

without interrupting rotation of the cranks, relocating both (i) a point of interconnection between the left foot supporting link and the left crank relative to the crank axis; and (ii) a point of interconnection between the right foot supporting link and the right crank relative to the crank axis.

* * * * *